US009969053B2

(12) United States Patent
Lee et al.

(10) Patent No.: US 9,969,053 B2
(45) Date of Patent: May 15, 2018

(54) GRINDER ADAPTOR ASSEMBLY

(71) Applicant: GM GLOBAL TECHNOLOGY OPERATIONS LLC, Detroit, MI (US)

(72) Inventors: Jae Min Lee, Sterling Heights, MI (US); John S. Agapiou, Rochester Hills, MI (US); James A. Bucan, Bruce Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 68 days.

(21) Appl. No.: 14/711,043

(22) Filed: May 13, 2015

(65) Prior Publication Data

US 2016/0332281 A1 Nov. 17, 2016

(51) Int. Cl.

| | |
|---|---|
| ***B24B 45/00*** | (2006.01) |
| ***B24B 5/42*** | (2006.01) |
| *B27B 5/30* | (2006.01) |

(52) U.S. Cl.

CPC ..... *B24B 45/006* (2013.01); *B24B 5/42* (2013.01); *B27B 5/30* (2013.01)

(58) Field of Classification Search

CPC ..... B24B 45/00; B24B 45/006; B24B 5/42; B24B 5/30; B24B 5/32; B24B 45/003; Y10T 83/9379; Y10T 279/16; Y10T 279/33; B25F 3/00; B27B 19/006

USPC ..... 451/62, 360, 362, 5

See application file for complete search history.

(56) References Cited

U.S. PATENT DOCUMENTS

| | | | | |
|---|---|---|---|---|
| 1,576,645 A | | 3/1926 | Eskew et al. | |
| 2,251,470 A | * | 8/1941 | Stacey | A43D 87/00 12/88 |
| 2,526,998 A | * | 10/1950 | Davis | B23B 31/113 279/93 |
| 3,270,467 A | * | 9/1966 | Block | B24D 7/16 451/509 |

(Continued)

FOREIGN PATENT DOCUMENTS

| | | |
|---|---|---|
| CN | 1207698 A | 2/1999 |
| CN | 201128114 Y | 10/2008 |

(Continued)

OTHER PUBLICATIONS

Jucam CBN Camshaft Grinding brochure from http://www.sellusedmachinery.com/listingbrochures/124284416452869758.pdf; retrieved on Feb. 12, 2015; 8 pages.

*Primary Examiner* — Joseph J Hail
*Assistant Examiner* — Arman Milanian
(74) *Attorney, Agent, or Firm* — Quinn IP Law

(57) ABSTRACT

A grinder assembly includes a spindle selectively rotatable about a central axis. The grinder assembly also includes a grinding wheel attachable to and detachable from the spindle. The grinding wheel is rotatable about the central axis when attached to the spindle. The grinder assembly further includes an adaptor cooperating with the spindle and the grinding wheel to provide a quick attachment and detachment of the grinding wheel with the spindle. The adaptor includes a plurality of first teeth extending outwardly relative to the spindle and a plurality of second teeth extending outwardly relative to the grinding wheel. The first and second teeth cooperate with each other to selectively attach the grinding wheel to the spindle and prevent independent rotation of the grinding wheel relative to the spindle.

20 Claims, 4 Drawing Sheets

(56) References Cited

U.S. PATENT DOCUMENTS 3,353,306 A * 11/1967 Seymour ..... B24B 45/00 451/342
3,540,163 A * 11/1970 Shoemaker ..... B24D 7/04 451/548
3,562,843 A * 2/1971 Belicka et al. ..... A46B 13/008 15/180
3,600,735 A * 8/1971 Jerabek ..... A47L 11/164 15/159.1
3,716,951 A 2/1973 Walters
4,297,926 A * 11/1981 Russ ..... B23B 5/18 451/249
4,336,991 A * 6/1982 Isobe ..... G03B 17/14 359/828
4,393,626 A * 7/1983 Schroer ..... B24D 5/16 409/234
4,637,170 A * 1/1987 Block ..... B24B 45/006 451/342
4,907,376 A * 3/1990 Bouchard ..... B24D 7/14 451/342
5,478,271 A * 12/1995 Thibaut ..... B23Q 1/0063 451/342
5,806,132 A * 9/1998 Kelley ..... A47L 11/164 15/230.17
5,855,451 A * 1/1999 Milton ..... B62D 1/10 403/328
6,213,521 B1 * 4/2001 Land ..... F16L 37/244 285/317
6,523,214 B1 * 2/2003 Kaiser ..... B24B 23/022 15/180
6,830,090 B2 * 12/2004 Foster ..... B24B 37/22 156/228
6,878,043 B1 * 4/2005 Junker ..... B24B 5/42 451/249
7,351,133 B1 * 4/2008 Lemberger ..... B24D 7/16 451/546
D619,152 S * 7/2010 Evatt ..... D15/138
9,265,397 B2 * 2/2016 Larson ..... A47L 11/283
2005/0208886 A1 * 9/2005 Wirz ..... B24B 45/00 451/342
2007/0049182 A1 * 3/2007 Burgess ..... B23F 15/06 451/51
2008/0096478 A1 * 4/2008 Belly ..... B24B 13/01 451/510
2009/0258576 A1 * 10/2009 Mizutani ..... B24B 5/42 451/53
2010/0183364 A1 * 7/2010 Harif ..... B23B 31/4073 403/295
2012/0292864 A1 * 11/2012 Zhou ..... B27B 5/32 279/141

FOREIGN PATENT DOCUMENTS

CN 201279735 Y 7/2009
CN 102267084 A 12/2011
CN 102333619 A 1/2012
CN 102430976 A 5/2012
CN 202702011 U 1/2013
CN 203228110 U 10/2013
DE 4444496 A1 * 6/1996 ..... B23D 57/0076
EP 2915630 A1 9/2015
WO WO 2008149369 A1 * 12/2008 ..... B23B 31/4073
WO WO 2013008154 A1 * 1/2013 ..... B27B 5/32

* cited by examiner

GRINDER ADAPTOR ASSEMBLY

TECHNICAL FIELD

The present disclosure relates to a grinder assembly.

BACKGROUND

Various surfaces of various parts can be refined by a grinding wheel. For example, various surfaces of a crankshaft can be refined by the grinding wheel. The crankshaft can include main journals and pin journals that the grinding wheel can engage.

Generally, a CNC machine can be utilized to move the grinding wheel to refine the crankshaft. The CNC machine includes a spindle that is rotatable. The grinding wheel is attached to the spindle such that rotation of the spindle causes rotation of the grinding wheel. However, each time the grinding wheel is attached to the spindle, maintenance is completed on the grinding wheel to prepare the grinding wheel for engagement with the main or pin journals.

SUMMARY

The present disclosure provides a grinder assembly including a spindle selectively rotatable about a central axis. The grinder assembly also includes a grinding wheel attachable to and detachable from the spindle. The grinding wheel is rotatable about the central axis when attached to the spindle. The grinder assembly further includes an adaptor cooperating with the spindle and the grinding wheel to provide a quick attachment and detachment of the grinding wheel with the spindle. The adaptor includes a plurality of first teeth extending outwardly relative to the spindle and a plurality of second teeth extending outwardly relative to the grinding wheel. The first and second teeth cooperate with each other to selectively attach the grinding wheel to the spindle and prevent independent rotation of the grinding wheel relative to the spindle.

The present disclosure also provides a grinder assembly that includes a CNC machine and a spindle supported by the CNC machine. The spindle is selectively rotatable about a central axis. Rotation of the spindle is controlled by the CNC machine. The assembly also includes a grinding wheel attachable to and detachable from the spindle. The grinding wheel is rotatable about the central axis when attached to the spindle. The assembly further includes an adaptor cooperating with the spindle and the grinding wheel to provide a quick attachment and detachment of the grinding wheel with the spindle. The adaptor includes a plurality of first teeth extending outwardly relative to the spindle and a plurality of second teeth extending outwardly relative to the grinding wheel. The first and second teeth cooperate with each other to selectively attach the grinding wheel to the spindle and prevent independent rotation of the grinding wheel relative to the spindle.

The detailed description and the drawings or Figures are supportive and descriptive of the disclosure, but the claim scope of the disclosure is defined solely by the claims. While some of the best modes and other embodiments for carrying out the claims have been described in detail, various alternative designs and embodiments exist for practicing the disclosure defined in the appended claims.

DETAILED DESCRIPTION

Those having ordinary skill in the art will recognize that terms such as "above", "below", "upward", "up", "downward", "down", "top", "bottom", "left", "right", "back", "forth", etc., are used descriptively for the figures to aid the reader's understanding of the present disclosure, and do not create limitations, particularly as to the position, orientation, use of the disclosure or scope as defined by the appended claims. Furthermore, the term "substantially" can refer to a slight imprecision or slight variance of a condition, quantity, value, or dimension, etc., some of which that are within manufacturing variance or tolerance ranges.

Figure 1:
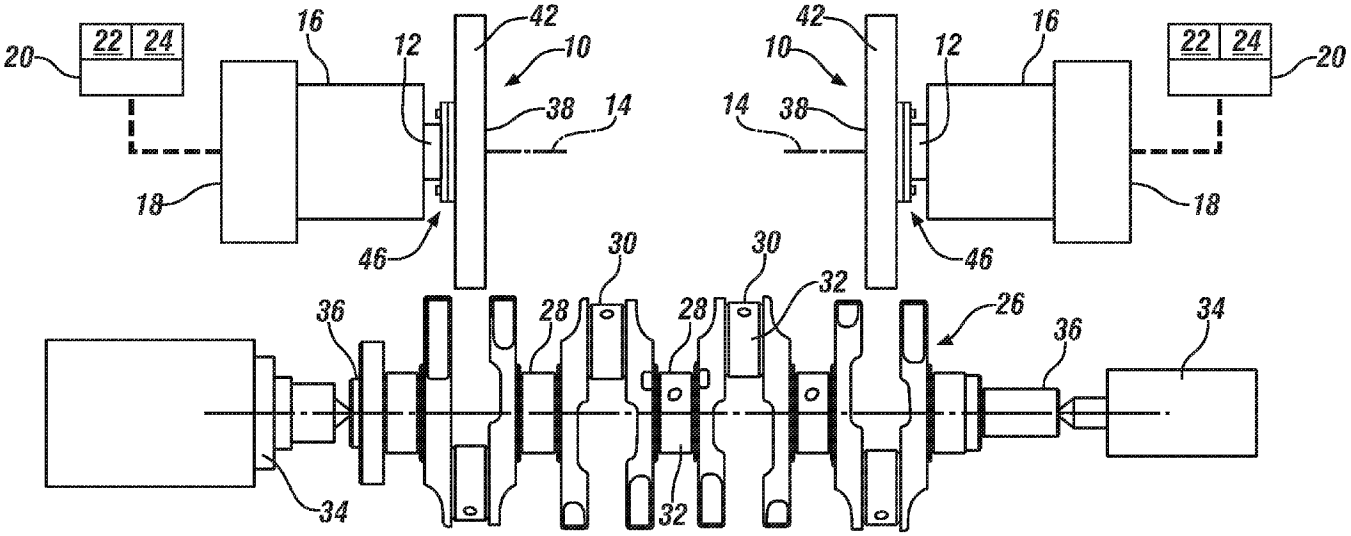
FIG. 1 is a schematic side view of a grinder assembly.

Referring to the Figures, wherein like numerals indicate like or corresponding parts throughout the several views, a grinder assembly 10 is generally shown in FIG. 1.

Continuing with FIG. 1, the grinder assembly 10 includes a spindle 12 selectively rotatable about a central axis 14. Furthermore, the grinder assembly 10 can include a support structure 16 that supports the spindle 12. The support structure 16 can be a housing, a frame, a bracket, etc., or any feature that supports the spindle 12. The support structure 16 can be any suitable configuration.

For example, the grinder assembly 10 can include a machine 18 that includes the support structure 16. The machine 18 can control the movement of the spindle 12. For example, the machine 18 can control rotation of the spindle 12, and optionally, control the location of the spindle 12. Therefore, the machine 18 can control the rotation of the spindle 12 about the central axis 14 and also control the linear location of the spindle 12. As such, the machine 18 can move the spindle 12 in a plurality of degrees of freedom. For example, the machine 18 can move the spindle 12 linearly up and down, and/or move the spindle 12 linearly back and forth, etc. In addition, the machine 18 can start and stop movement of the spindle 12 as desired.

In certain embodiments, the machine 18 is a computer numeric controlled (CNC) machine 18. The spindle 12 can be supported by the CNC machine 18, and thus, rotation of the spindle 12 can be controlled by the CNC machine 18 and linear movement of the spindle 12 can be controlled by the CNC machine 18. As such, when utilizing the CNC machine 18, the CNC machine 18 can be programmed to start/stop rotation and/or start/stop linear movement at a particular position. Therefore, the machine 18 can include a controller 20. The machine 18 can be any suitable type of machine 18, and the CNC machine 18 is one non-limiting example.

The controller 20 can include a processor 22 and a memory 24 on which is recorded instructions for communicating instructions to start/stop movement of the spindle 12. The controller 20 is configured to execute the instructions from the memory 24, via the processor 22. For example, the controller 20 can be a host machine or distributed system, e.g., a computer such as a digital computer or microcomputer, acting as a control module having the processor 22, and the memory 24. The memory 24 can be tangible, non-transitory computer-readable memory such as read-only memory (ROM) or flash memory. The controller 20 can also have random access memory (RAM), electrically erasable programmable read only memory (EEPROM), a high-speed clock, analog-to-digital (A/D) and/or digital-to-analog (D/A) circuitry, and any required input/output circuitry and associated devices, as well as any required signal conditioning and/or signal buffering circuitry. Therefore, the controller 20 can include all software, hardware, memory 24, algorithms, connections, sensors, etc., necessary to monitor and control the spindle 12. It is to be appreciated that the controller 20 can also include any device capable of analyzing data from various sensors, comparing data, making the necessary decisions required to control the spindle 12.

Optionally, more than one machine 18 can be utilized as illustrated in FIG. 1. As such, more than one controller 20 can optionally be utilized. Therefore, one controller 20 can control both machines 18 or each machine 18 can have its own controller 20. If each machine 18 includes a controller 20, each of the controllers 20 can optionally communicate with each other. Two machines 18 are illustrated in FIG. 1, but any desired number of machines 18 can be utilized. When utilizing more than one of the machines 18, each of the machines 18 can support separate grinder assemblies 10. Alternatively, one machine 18 can support and control separate grinder assemblies 10. Only one grinder assembly 10 for one machine 18 is discussed below but the grinder assembly 10 for the other machines 18 can be configured the same as described below.

Figure 2:
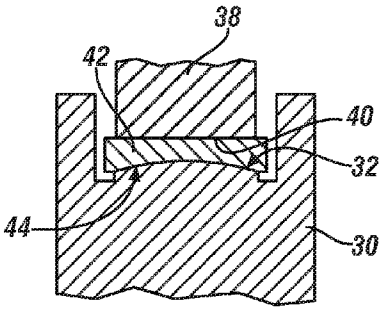
FIG. 2 is a schematic fragmentary cross-sectional view of a part and a grinding wheel.

A part 26 can be refined or finished by utilizing the grinder assembly 10. The part 26 can be any suitable configuration. For illustrative purposes only, the part 26 illustrated in FIG. 1 is a crankshaft. Generally, the crankshaft can include a plurality of main journals 28 and a plurality of pin journals 30. Turning to FIGS. 1 and 2, the grinder assembly 10 can be utilized to finish an outer surface 32 or profile of the part 26, such as one or more outer surfaces 32 of the main journals 28 and/or the pin journals 30. Generally, the outer surface 32 of the part 26 can be curved or crowned, or alternatively, flat. For example, the outer surface 32 of the pin journals 30 can be curved or crowned (see FIG. 2), and optionally the outer surface 32 of the main journals 28 can be curved or crowned, so it is desirable to refine or finish that curved outer surface 32. Alternatively, the outer surface 32 of the main journals 28 can be flat. Therefore, the grinder assembly 10 can remove a desired amount of material from the outer surface 32 to further smooth that surface. Other non-limiting examples of the part 26 can include a camshaft, various transmission components, a shaft or any other part 26 that it is desirable to refine/finish one or more surfaces thereto.

The part 26 is coupled to a holder 34 (see FIG. 1) and the holder 34 supports the part 26. The machine 18 can optionally include the holder 34, and thus, the machine 18 can optionally control movement of the holder 34. The holder 34 can be one or more pieces depending on the parameters of the part 26. For example, as shown in FIG. 1, the holder 34 can include two pieces which supports each end 36 of the part 26. Optionally, the holder 34 can selectively move the part 26. For example, the holder 34 can rotate the part 26 and/or move the part 26 linearly, i.e., up and down and/or back and forth. As such, the machine 18 can start and stop movement of the holder 34 as desired. Therefore, one of the controllers 20 for one of the machines 18 can control movement of the holder 34, or alternatively, another controller 20 can be in communication with the holder 34 to control movement of the holder 34. If the holder 34 includes a separate controller 20, the controller 20 for the holder 34 can optionally be in communication with one or both of the controllers 20 of the machines 18.

The grinder assembly 10 further includes a grinding wheel 38 attachable to and detachable from the spindle 12. FIG. 1 illustrates the grinding wheel 38 attached to the spindle 12. The grinding wheel 38 is rotatable about the central axis 14 when attached to the spindle 12. Therefore, if the spindle 12 is rotating, the grinding wheel 38 rotates simultaneously or concurrently with the spindle 12.

Referring to FIG. 2, generally, the grinding wheel 38 can include an outer periphery 40 that faces outwardly toward the part 26. An abrasive material 42 can be attached to the outer periphery 40 and the abrasive material 42 selectively engages the part 26 to refine one or more of the outer surfaces 32 of the part 26. The abrasive material 42 can be permanently bonded to the outer periphery 40 and when the abrasive material 42 wears to a predetermined level, the grinding wheel 38 is replaced with another grinding wheel 38 that has new abrasive material 42.

As shown in FIG. 2, depending on the desired contour of the outer surface 32 of the part 26, the abrasive material 42 can present a contact surface 44 that cooperates with the outer surface 32 of the part 26. The abrasive material 42 is dressed to create the contact surface 44 that will be used to refine the outer surface 32 of the part 26. For example, the contact surface 44 of the abrasive material 42 can be dressed to present a curved surface or a flat surface depending on the desired contour of the outer surface 32 of the part 26. Since different parts 26 can be refined with the grinder assembly 10, different grinding wheels 38 are dressed for different configurations of the outer surface 32 of different parts 26.

As best shown in FIGS. 1, 3-5 and 9, the grinder assembly 10 also includes an adaptor 46 cooperating with the spindle 12 and the grinding wheel 38 to provide a quick attachment and detachment of the grinding wheel 38 with the spindle 12. When the grinding wheel 38 is attached to the spindle 12 for the first time, the grinding wheel 38 is dressed to the desired contour to finish the outer surface 32 of the desired part 26. Therefore, the contour of the abrasive material 42 is dressed for refining the desired part 26. When it is desirable to change one grinding wheel 38 with another grinding wheel 38, the adaptor 46 provides a quick and easy way to switch the wheels. Furthermore, as discussed further below, the adaptor 46 provides repeatability of changing the grinding wheels 38 while minimizing the need to dress the grinding wheels 38 before each use when reattached to the spindle 12.

The adaptor 46 includes a plurality of first teeth 48 (see FIG. 9) extending outwardly relative to the spindle 12 and a plurality of second teeth 50 (see FIG. 5) extending outwardly relative to the grinding wheel 38. The first teeth 48 are spaced from each other and, in certain embodiments, can be spaced radially about the central axis 14. Additionally, the second teeth 50 are spaced from each other and, in certain embodiments, can be spaced radially about the central axis 14. The first teeth 48 can be spaced from each other any suitable distance and similarly, the second teeth 50 can be spaced from each other any suitable distance. The first and second teeth 48, 50 cooperate with each other to selectively attach the grinding wheel 38 to the spindle 12 and prevent independent rotation of the grinding wheel 38 relative to the spindle 12. Generally, the first and second teeth 48, 50 cooperate with each other in an alternating pattern. In other words, one of the first teeth 48 is disposed between a pair of second teeth 50, and so on around the adaptor 46. For example, contact between respective first and second teeth 48, 50 limit radial movement of the grinding wheel 38 relative to the central axis 14 when the grinding wheel 38 is attached to the spindle 12. Therefore, engagement between the teeth 48, 50 minimizes radial run-out, i.e., minimizes radial movement of the grinding wheel 38 relative to the central axis 14.

The first and second teeth 48, 50 can be any suitable configuration and the figures are non-limiting examples. Therefore, the first and second teeth 48, 50 can be wider or narrower than illustrated. The first and second teeth 48, 50 can be tapered, square, rounded, etc. More or less first and second teeth 48, 50 can be utilized than illustrated. Furthermore, the first and second teeth 48, 50 can be grouped in a pattern. For example, there can be a group of a certain number of teeth 48, 50 and then another group of the same number of teeth 48, 50 a distance away from the first group of teeth 48, 50, etc.

Referring to FIG. 1, the adaptor 46 can include a first portion 52 cooperating with a distal end 54 of the spindle 12 and a second portion 56 cooperating with the grinding wheel 38. In certain embodiments, the first portion 52 can include the first teeth 48 (see FIG. 9) extending outwardly therefrom and the second portion 56 can include the second teeth 50 (see FIG. 5) extending outwardly therefrom.

Figure 3:
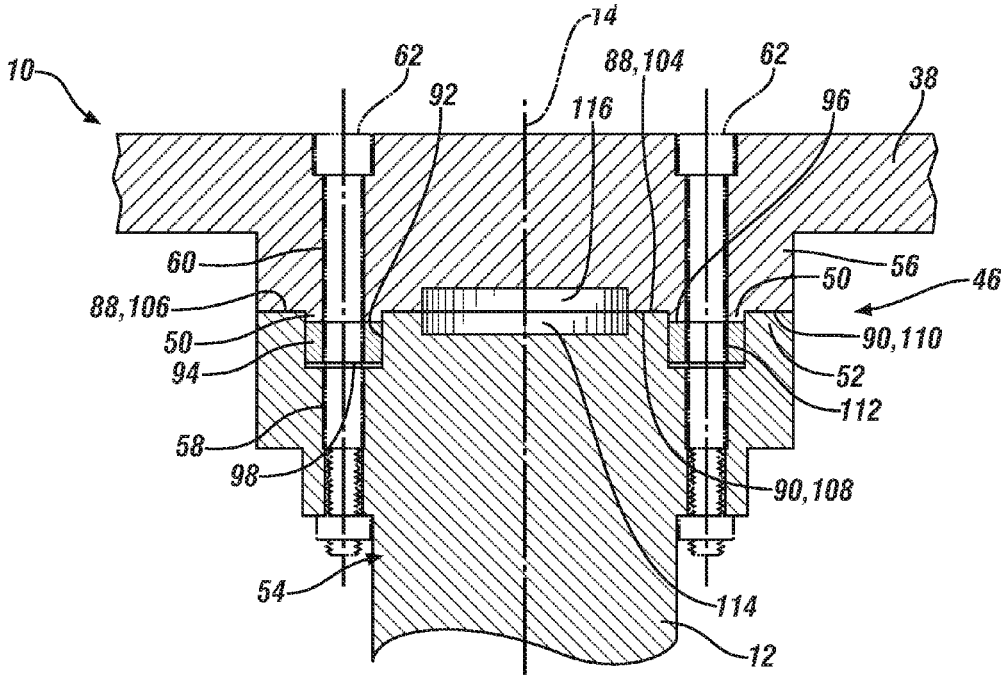
FIG. 3 is a schematic cross-sectional view of one embodiment of an adaptor.

In certain embodiments, as best shown in FIG. 3, the first portion 52 of the adaptor 46 is integrated into the distal end 54 of the spindle 12 such that the first portion 52 and the spindle 12 are one piece. Furthermore, in this embodiment, the second portion 56 of the adaptor 46 is integrated into the grinding wheel 38 such that the second portion 56 and the grinding wheel 38 are one piece. Therefore, in this embodiment, for example, the first portion 52 and the spindle 12 can be permanently fixed together, and similarly, the second portion 56 and the grinding wheel 38 can be permanently fixed together. As such, removable fasteners are not utilized to integrate the first portion 52 to the spindle 12 or the second portion 56 to the grinding wheel 38.

Continuing with the integrated embodiment, the first portion 52 can define a plurality of first holes 58 (see FIG. 9) spaced from each other and the second portion 56 can define a plurality of second holes 60 (see FIG. 5) spaced from each other. The second holes 60 align with respective first holes 58. Therefore, when attaching the grinding wheel 38 to the spindle 12, the first and second holes 58, 60 are aligned with each other. A plurality of first fasteners 62 (the first fasteners 62 are shown in phantom lines in FIG. 3) are utilized to attach the grinding wheel 38 to the spindle 12. As such, one of the first fasteners 62 is disposed through each of the first and second holes 58, 60 that align with each other such that the first fasteners 62 attach the grinding wheel 38 to the spindle 12. The first fasteners 62 are tightened to attach the grinding wheel 38 to the spindle 12, and no other fasteners are needed to prepare the grinding wheel 38 or the spindle 12 for attachment therebetween. Any suitable number of first and second holes 58, 60, and correspondingly the first fasteners 62, can be utilized and the Figures are illustrative only.

Figure 4:
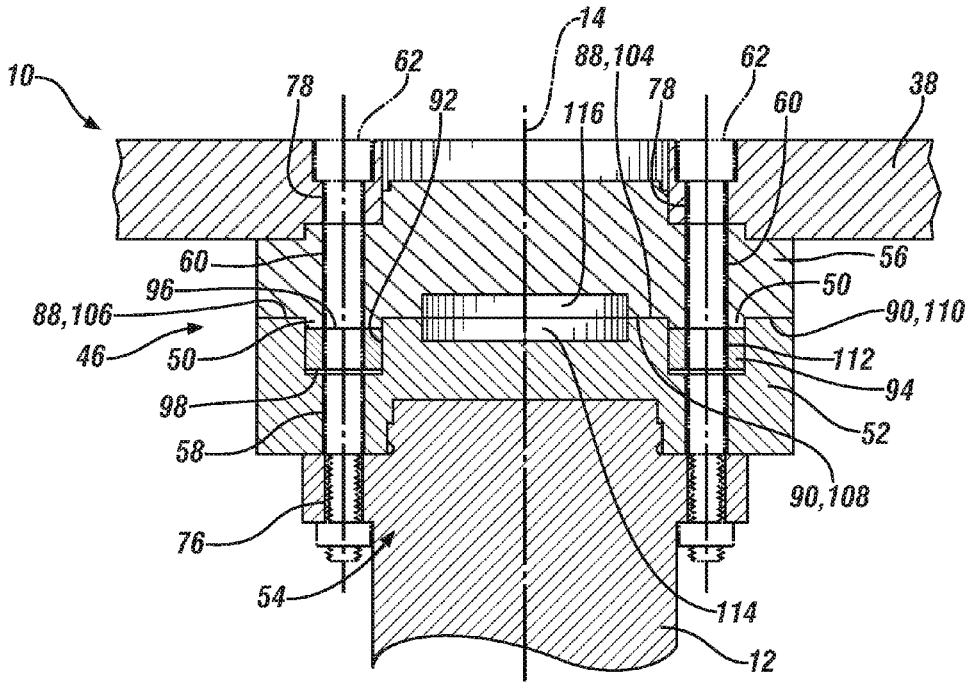
FIG. 4 is a schematic cross-sectional view of another embodiment of the adaptor.

In other embodiments, as best shown in FIG. 4, the first portion 52 of the adaptor 46 is a separate piece attached to the distal end 54 of the spindle 12. Furthermore, in this embodiment, the second portion 56 of the adaptor 46 is a separate piece attached to the grinding wheel 38. Therefore, in this embodiment, the first portion 52 is attached to the spindle 12 before the grinding wheel 38 can be attached to the spindle 12, and similarly, the second portion 56 is attached to the grinding wheel 38 before the grinding wheel 38 can be attached to the spindle 12. Therefore, additional holes/fasteners are utilized for the embodiment of FIG. 4 as compared to the embodiment of FIG. 3.

Continuing with the individual piece embodiment, the first portion 52 defines the plurality of first holes 58 (see FIG. 9) spaced from each other and the second portion 56 defines the plurality of second holes 60 (see FIG. 5) spaced from each other, as similarly discussed for the other embodiment. The second holes 60 align with respective first holes 58. Therefore, when attaching the grinding wheel 38 to the spindle 12, the first and second holes 58, 60 are aligned with each other. As such, the first and second portions 52, 56 are attached to each other by the first fasteners 62, and correspondingly the grinding wheel 38 is attached to the spindle 12 through the first and second portions 52, 56. Again, the first fasteners 62 (the first fasteners 62 are shown in phantom lines in FIG. 4) are utilized to attach the grinding wheel 38 to the spindle 12. As such, one of the first fasteners 62 is disposed through each of the first and second holes 58, 60 that align with each other such that the first fasteners 62 attach the grinding wheel 38 to the spindle 12.

Figure 14:
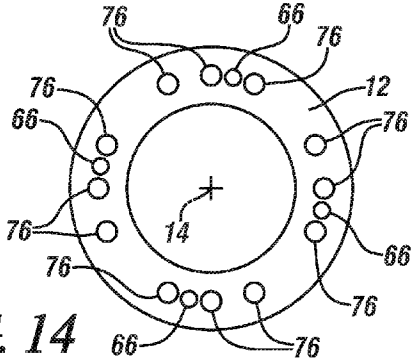
FIG. 14 is a schematic end view of a spindle compatible with FIG. 4.

Continuing with the individual piece embodiment, the first portion 52 can define a plurality of third holes 64 (see FIG. 9) spaced from each other and spaced from the first holes 58. Furthermore, the distal end 54 of the spindle 12 can define a plurality of fourth holes 66 (one fourth hole 66 is shown in phantom lines in FIG. 13; also see FIG. 14) spaced from each other. Respective third and fourth holes 64, 66 align with each other. Therefore, to attach the first portion 52 and the spindle 12 together, respective third and fourth holes 64, 66 are aligned with each other.

A plurality of second fasteners 68 (see FIGS. 9 and 13) are utilized to attach the first portion 52 of the adaptor 46 to the spindle 12. Therefore, one of the second fasteners 68 is disposed through each of the third and fourth holes 64, 66 that align with each other such that the second fasteners 68 attach the first portion 52 of the adaptor 46 to the spindle 12. Once the first portion 52 is secured to the spindle 12 by the second fasteners 68, the first portion 52 can remain attached thereto for the life of the spindle 12 or until replacement of the first portion 52 is desired.

Figure 15:
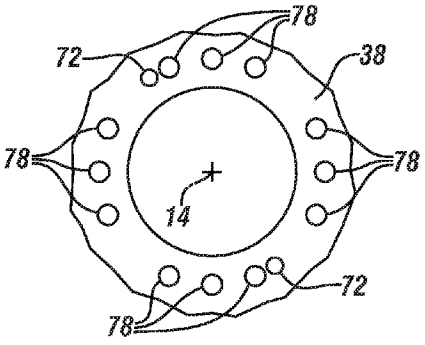
FIG. 15 is a schematic fragmentary side view of a grinding wheel compatible with FIG. 4.
Figure 8:
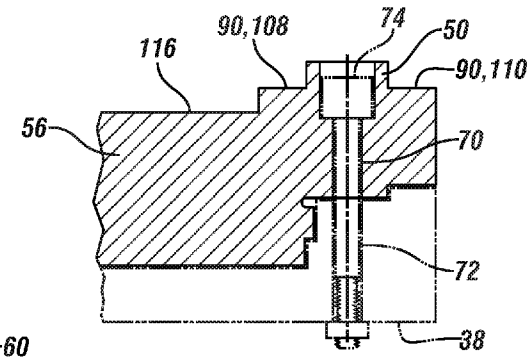
FIG. 8 is a schematic fragmentary cross-sectional view of the second portion taken from lines 8-8 of FIG. 5.
Figure 16:
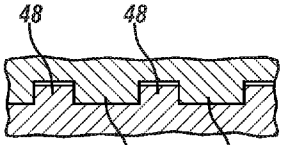
FIG. 16 is a schematic fragmentary cross-sectional view of first and second teeth cooperating with each other.

Again continuing with the individual piece embodiment, the second portion 56 can optionally define a plurality of fifth holes 70 (see FIG. 8) spaced from each other and spaced from the second holes 60. The grinding wheel 38 can optionally define a plurality of sixth holes 72 (see FIG. 15)

spaced from each other. Respective fifth and sixth holes 70, 72 align with each other. Therefore, to attach the second portion 56 and the grinding wheel 38 together, the fifth and sixth holes 70, 72 are aligned with each other.

A plurality of third fasteners 74 (see FIG. 8) are utilized to attach the second portion 56 of the adaptor 46 to the grinding wheel 38. Therefore, one of the third fasteners 74 is disposed through each of the fifth and sixth holes 70, 72 that align with each other such that the third fasteners 74 attach the second portion 56 of the adaptor 46 to the grinding wheel 38. Once the second portion 56 is secured to the grinding wheel 38, the second portion 56 can remain attached thereto for the life of the grinding wheel 38 or until replacement of the second portion 56 is desired. As indicated above, the fifth and sixth holes 70, 72 are optional, and instead of securing the second portion 56 to the grinding wheel 38 with the third fasteners 74, the second portion 56 and the grinding wheel 38 can be attached to each other by a press fit. Alternatively, both the press fit and third fasteners 74 can be utilized to attach the second portion 56 to the grinding wheel 38.

Additionally, for the individual piece embodiment, the distal end 54 of the spindle 12 can define a plurality of seventh holes 76 (see FIGS. 4 and 14) spaced from each other and spaced from the fourth holes 66. The seventh holes 76 align with respective first holes 58 of the first portion 52. One of the first fasteners 62 is disposed through each of the seventh holes 76 such that the first fasteners 62 attach the grinding wheel 38 to the spindle 12.

In addition, for the individual piece embodiment, the grinding wheel 38 can define a plurality of eighth holes 78 (see FIGS. 4 and 15) spaced from each other and spaced from the optional fifth holes 70. The eighth holes 78 align with respective second holes 60 of the second portion 56. One of the first fasteners 62 is disposed through each of the eighth holes 78 such that the first fasteners 62 attach the grinding wheel 38 to the spindle 12. Therefore, as best shown in FIG. 4, the first holes 58 of the first portion 52, the second holes 60 of the second portion 56, the seventh holes 76 of the spindle 12 and the eighth holes 78 of the grinding wheel 38, respectively, align to receive respective first fasteners 62. Any suitable number of the first-eighth holes 58, 60, 64, 66, 70, 72, 76, 78, and corresponding fasteners 62, 68, 74, can be utilized, and the Figures are illustrative only.

To interchange one grinding wheel 38 with another grinding wheel 38, the first fasteners 62 are removed which allows the grinding wheel 38 to separate from the spindle 12. For the individual piece embodiment, the first portion 52 remains attached to the spindle 12 by the second fasteners 68 and the second portion 56 remains attached to the grinding wheel 38 by the third fasteners 74 when the grinding wheel 38 is removed by the first fasteners 62. For the integrated embodiment, the third-eighth holes 64, 66, 70, 72, 76, 78 are eliminated, and correspondingly, the second and third fasteners 68, 74 are eliminated.

Turning to FIGS. 5, 7, 9 and 11, the adaptor 46 can include a locating feature 80 that positions the grinding wheel 38 relative to the spindle 12 in the same location each time the grinding wheel 38 is attached to the spindle 12. For example, the spindle 12 can be stopped at a certain position which positions the locating feature 80 in a particular orientation, and therefore, positions the grinding wheel 38 in a particular position such that the grinding wheel 38 does not need to be re-dressed when utilized again. The machine 18 can stop the grinding wheel 38 in the particular position, which can be referred to as a clocking position. Therefore, the machine 18, in combination with the locating feature 80, provides repeatability of attaching different grinding wheels 38 to the spindle 12 due to the accuracy of the positioning the grinding wheel 38 in the same location each time the grinding wheels 38 are changed. As such, the features of the adaptor 46 provide repeatability while minimizing the need to dress the grinding wheels 38 before each use when reattached to the spindle 12.

The locating feature 80 can be any suitable configuration and location, and the locating feature 80 can be utilized in both embodiments discussed herein. Below are non-limiting examples of the locating feature 80. The locating feature 80 can include a projection 82 (see FIG. 11) that extends outwardly relative to one of the first portion 52 and the second portion 56. Furthermore, the locating feature 80 can include an opening 84 (see FIG. 7) defined by the other one of the first portion 52 and the second portion 56. The projection 82 extends into the opening 84 when the grinding wheel 38 is attached to the spindle 12. In one embodiment, the projection 82 extends outwardly relative to the first portion 52 and the second portion 56 defines the opening 84. In another embodiment, the projection 82 extends outwardly relative to the second portion 56 and the first portion 52 defines the opening 84. The projection 82 can be a separate piece that is attached to one of the first and second portions 52, 56. For example, the projection 82 can be a bushing in which a pin 86 (discussed further below) secures the bushing to one of the first and second portions 52, 56. Instead of, or in addition to the projection 82, one tooth 48, 50 of the first or second portions 52, 56 can be a different configuration from the corresponding teeth 48, 50. As another example, the locating feature 80 can be a key and corresponding keyway, etc.

Figure 5:
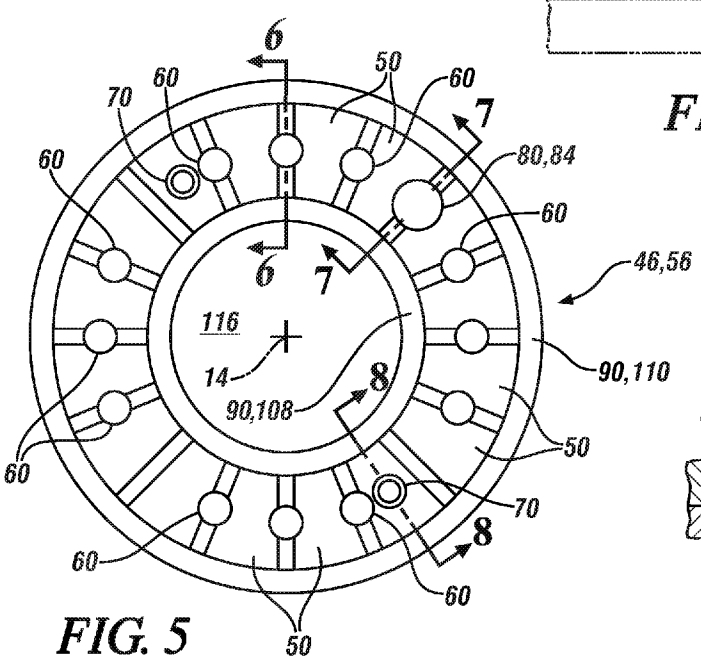
FIG. 5 is a schematic side view of a second portion of the adaptor.
Figure 6:
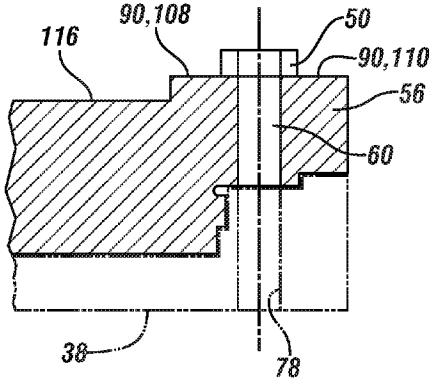
FIG. 6 is a schematic fragmentary cross-sectional view of the second portion taken from lines 6-6 of FIG. 5.
Figure 7:
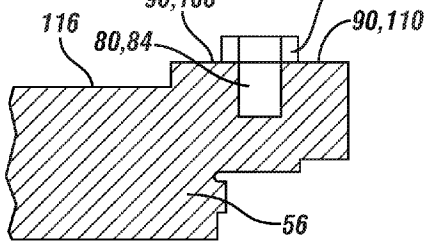
FIG. 7 is a schematic fragmentary cross-sectional view of the second portion taken from lines 7-7 of FIG. 5.

The first portion 52 can include a first face 88 (see FIG. 9) and the second portion 56 can include a second face 90 (see FIG. 5). Referring to FIGS. 3 and 4, at least a portion of the first and second faces 88, 90 engages each other to limit axial movement of the grinding wheel 38 relative to the spindle 12 when the grinding wheel 38 is attached to the spindle 12. Therefore, the first and second faces 88, 90 minimize axial run-out, i.e., minimizes axial movement of the grinding wheel 38 relative to the central axis 14.

In certain embodiments, as best shown in FIGS. 9-13, the first portion 52 can define a recess 92. The first portion 52 can include a component 94 disposed in the recess 92. The component 94 can include the first teeth 48. Therefore, the first teeth 48 can be spaced from the first face 88 of the first portion 52. Furthermore, the second fasteners 68 are spaced from the component 94, and thus, do not extend through the component 94. As such, the second fasteners 68 are covered by the component 94, and thus the second fasteners 68 are not visible from the first face 88.

The component 94 is movable axially relative to the central axis 14 such that the first face 88 of the first portion 52 engages the second face 90 of the second portion 56 when the grinding wheel 38 is attached to the spindle 12. For example, the component 94 is movable relative to the recess 92. Simply stated, the component 94 can move back and forth axially relative to the central axis 14. This movement of the component 94 allows the first and second portions 52, 56 to seat relative to each other in a desired relationship. Therefore, the component 94 of the first portion 52 is compressed down to obtain contact between the first and second faces 88, 90. The contact between the first and second faces 88, 90 controls the axial run-out of the grinding wheel 38 and the contact between the first and second teeth 48, 50 controls the radial run-out of the grinding wheel 38.

As discussed above, radial run-out refers to radial movement of the grinding wheel 38 relative to the central axis 14 and axial run-out refers to axial movement of the grinding wheel 38 relative to the central axis 14. The contact between the first and second faces 88, 90 maximizes the stiffness of the interface between the faces 88, 90; and the stiffness of the interface between the first and second faces 88, 90 can be changed by changing the number of teeth 48, 50 being utilized.

The adaptor 46 cooperates with the spindle 12 and the grinding wheel 38 to minimize radial and axial run-out of the grinding wheel 38, and thus provides that the grinding wheel 38 can run true relative to the central axis 14 which minimizes re-dressing of the wheel 38. The adaptor 46 also provides concentricity between the grinding wheel 38 and the spindle 12 relative to the central axis 14, and thus also provides that the grinding wheel 38 can run true which minimizes re-dressing of the wheel 38.

Figure 13:
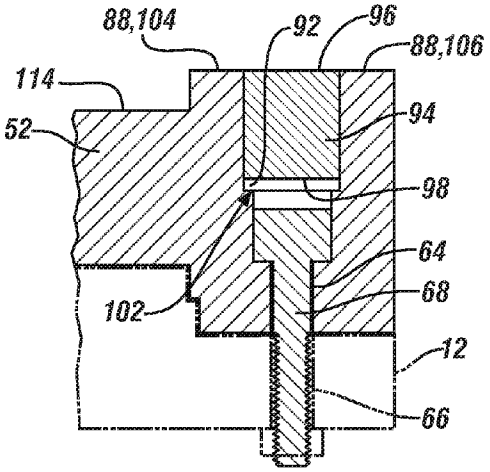
FIG. 13 is a schematic fragmentary cross-sectional view of the first portion taken from lines 13-13 of FIG. 9.

As best shown in FIG. 13, the component 94 can include a first side 96 and a second side 98 spaced from each other. In certain embodiments, the first and second sides 96, 98 oppose each other. The first side 96 is disposed proximal to the first face 88 and the first teeth 48 can extend outwardly from the first side 96 of the component 94.

Figure 12:
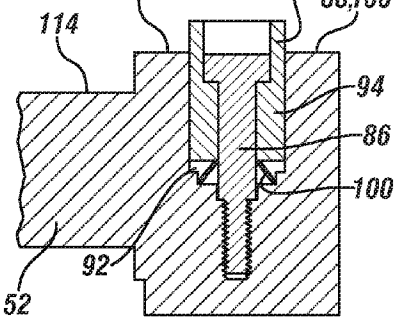
FIG. 12 is a schematic fragmentary cross-sectional view of the first portion taken from lines 12-12 of FIG. 9.
Figure 11:
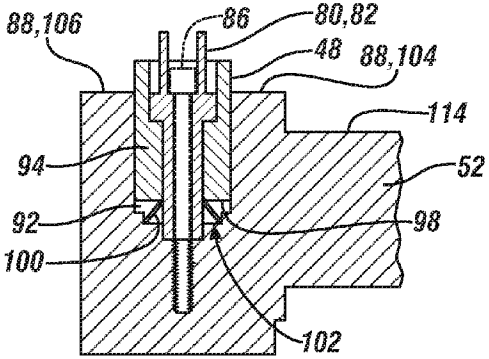
FIG. 11 is a schematic fragmentary cross-sectional view of the first portion taken from lines 11-11 of FIG. 9.
Figure 10:
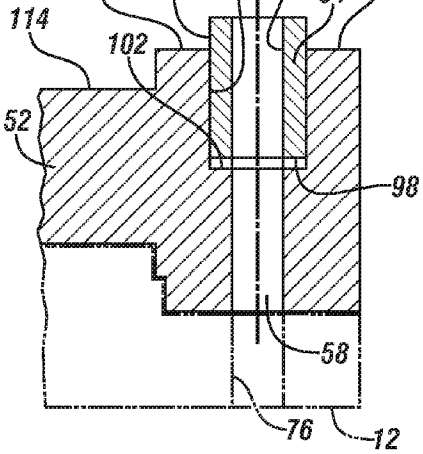
FIG. 10 is a schematic fragmentary cross-sectional view of the first portion taken from lines 10-10 of FIG. 9.

Turing to FIGS. 11 and 12, the first portion 52 can include a biasing member 100 disposed between the second side 98 and a bottom surface 102 of the recess 92 such that the biasing member 100 continuously biases the component 94 outwardly away from the bottom surface 102. The component 94 is biased outwardly a maximum distance away from the bottom surface 102 in FIGS. 10-13 and the component 94 is retracted back toward the bottom surface 102 in FIGS. 3 and 4. In certain embodiments, the biasing member 100 is further defined as a plurality of biasing members 100 disposed between the second side 98 and the bottom surface 102 of the recess 92. Any suitable number of biasing members 100 can be utilized.

The first portion 52 can also include a plurality of pins 86 fixed to the component 94 in a spaced relationship. The pins 86 can extend through the component 94 and are secured to the first portion 52 (see FIG. 12). The pin 86 for the locating feature 80, as shown in FIG. 11, can be configured differently if desired. As such, the pin 86 for the locating feature 80 can also be disposed through the projection 82 and secured to the first portion 52. At least one of the biasing members 100 surrounds part 26 of each of the pins 86. In certain embodiments, a plurality of biasing members 100 are stacked together about each of the pins 86. Alternatively, one biasing member 100 surrounds part 26 of each of the pins 86 as shown in FIGS. 11 and 12.

Figure 9:
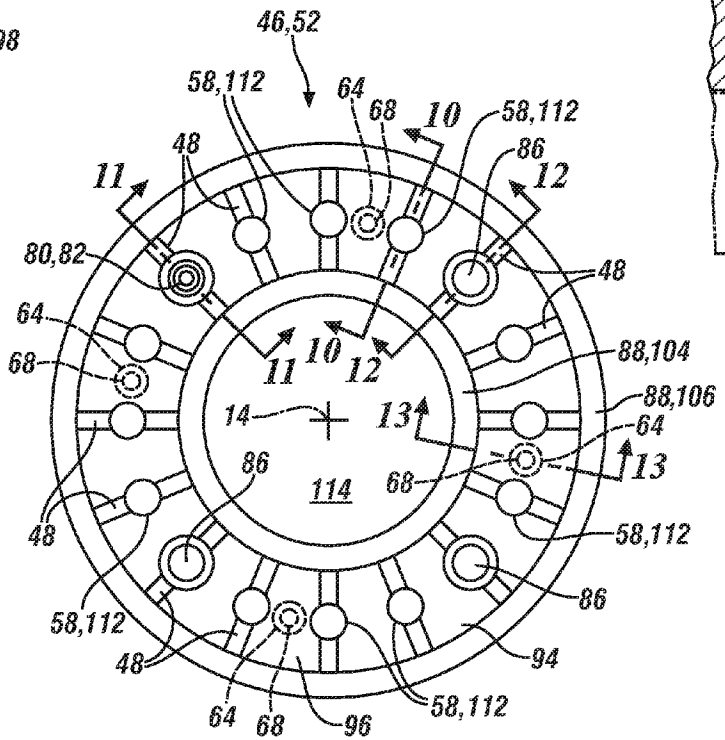
FIG. 9 is a schematic side view of a first portion of the adaptor.

Turning to FIGS. 3, 4 and 10-13, the first face 88 can include a first platform 104 and a second platform 106 each being substantially flat. For example, the first and second platforms 104, 106 can be coincident surfaces. In certain embodiments, the first and second platforms 104, 106 are separated by the component 94. In other words, the component 94 is disposed between the first and second platforms 104, 106. As such, when the component 94 includes the first teeth 48, the first teeth 48 can be spaced from the first and second platforms 104, 106. The component 94 can be any suitable configuration, and one non-limiting example is illustrated in FIG. 9, in which the component 94 is generally a ring. One other non-limiting example is that the component 94 is circular in configuration such that the component 94 extends across the center of the first portion 52.

Turning to FIGS. 3, 4 and 6-8, the second face 90 can include a third platform 108 and a fourth platform 110 each being substantially flat. For example, the third and fourth platforms 108, 110 can be coincident surfaces. In certain embodiments, the third and fourth platforms 108, 110 are separated by the second teeth 50. In other words, the second teeth 50 are disposed between the third and fourth platforms 108, 110. Generally, the first and third platforms 104, 108 engage each other when the component 94 biases back toward the bottom surface 102 when the grinding wheel 38 is attached to the spindle 12. Furthermore, the second and fourth platforms 106, 110 engage each other when the component 94 biases back toward the bottom surface 102 when the grinding wheel 38 is attached to the spindle 12. As such, the first and third platforms 104, 108 seat against each other when the component 94 biases back toward the bottom surface 102 when the grinding wheel 38 is attached to the spindle 12, and similarly, the second and fourth platforms 106, 110 seat against each other when the component 94 biases back toward the bottom surface 102 when the grinding wheel 38 is attached to the spindle 12. Therefore, engagement between the first and third platforms 104, 108, and the second and fourth platforms 106, 110 minimizes axial run-out, i.e., minimizes axial movement of the grinding wheel 38 relative to the central axis 14.

Referring to FIGS. 3, 4, 9 and 10, the component 94 can also define a plurality of first apertures 112 spaced from each other. The first holes 58 align with respective first apertures 112. As such, one of the first fasteners 62 is disposed through each of the first apertures 112 when the grinding wheel 38 is attached to the spindle 12. Therefore, as best shown in FIG. 4, the first holes 58 of the first portion 52, the second holes 60 of the second portion 56, the seventh holes 76 of the spindle 12, the eighth holes 78 of the grinding wheel 38 and the first apertures 112 of the component 94, respectively, align to receive respective first fasteners 62. Any suitable number of first apertures 112 can be utilized.

As best shown in FIGS. 3 and 4, the first portion 52 can define a first recessed portion 114 and the second portion 56 can define a second recessed portion 116. The first recessed portion 114 extends inwardly toward the spindle 12 and the second recessed portion 116 extends inwardly toward the grinding wheel 38. The first platform 104 of the first face 88 and the first recessed portion 114 is disposed adjacent to each other or is juxtaposed next to each other. The third platform 108 of the second face 90 and the second recessed portion 116 is disposed adjacent to each other or is juxtaposition next to each other. When the grinding wheel 38 is attached to the spindle 12, the first and second recessed portions 114, 116 substantially align with each other such that there is no contact between the first and second portions 52, 56 along the recessed portions 114, 116.

While the best modes and other embodiments for carrying out the disclosure have been described in detail, those familiar with the art to which this disclosure relates will recognize various alternative designs and embodiments for practicing the disclosure within the scope of the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings. Accordingly, such other embodiments fall within the framework of the scope of the appended claims.

The invention claimed is:

1. A grinder assembly comprising:

a spindle selectively rotatable about a central axis;

a grinding wheel attachable to and detachable from the spindle, with the grinding wheel rotatable about the central axis when attached to the spindle; and an adaptor cooperating with the spindle and the grinding wheel to provide a quick attachment and detachment of the grinding wheel with the spindle, and wherein the adaptor includes a plurality of first teeth extending outwardly relative to the spindle and a plurality of second teeth extending outwardly relative to the grinding wheel, with the first and second teeth cooperating with each other to selectively attach the grinding wheel to the spindle and prevent independent rotation of the grinding wheel relative to the spindle;

wherein:

the adaptor includes a first portion cooperating with the spindle and a second portion cooperating with the grinding wheel;

the first portion includes a first face and the second portion includes a second face;

the first portion defines a recess and includes a component disposed in the recess, with the component movable axially relative to the central axis such that the first face of the first portion engages the second face of the second portion when the grinding wheel is attached to the spindle;

the first portion cooperates with a distal end of the spindle;

the first portion includes the first teeth extending outwardly therefrom;

the second portion includes the second teeth extending outwardly therefrom, with contact between respective first and second teeth limiting radial movement of the grinding wheel relative to the central axis when the grinding wheel is attached to the spindle;

at least a portion of the first and second faces engage each other to limit axial movement of the grinding wheel relative to the spindle when the grinding wheel is attached to the spindle;

the component includes a first side and a second side spaced from each other, with the first side disposed proximal to the first face and the first teeth extend outwardly from the first side of the component and the first portion includes a biasing member disposed between the second side and a bottom surface of the recess such that the biasing member continuously biases the component outwardly away from the bottom surface;

the biasing member is further defined as a plurality of biasing members disposed between the second side and the bottom surface of the recess;

the first portion includes a plurality of pins fixed to the component in a spaced relationship, with at least one of the biasing members surrounding part of each of the pins.

2. The assembly as set forth in claim 1 wherein the adaptor includes a locating feature that positions the grinding wheel relative to the spindle in the same location each time the grinding wheel is attached to the spindle.

3. The assembly as set forth in claim 2 wherein the locating feature includes a projection extending outwardly relative to one of the first portion and the second portion, and wherein the locating feature includes an opening defined by the other one of the first portion and the second portion, with the projection extending into the opening when the grinding wheel is attached to the spindle.

4. The assembly as set forth in claim 1 wherein:

the first face includes a first platform and a second platform each being substantially flat, with the first and second platforms separated by the component;

the second face includes a third platform and a fourth platform each being substantially flat, with the third and fourth platforms separated by the second teeth; and the first and third platforms engage each other when the component biases back toward the bottom surface when the grinding wheel is attached to the spindle, and the second and fourth platforms engage each other when the component biases back toward the bottom surface when the grinding wheel is attached to the spindle.

5. The assembly as set forth in claim 1 wherein the first portion of the adaptor is integrated into the distal end of the spindle such that the first portion and the spindle are one piece and the second portion of the adaptor is integrated into the grinding wheel such that the second portion and the grinding wheel are one piece.

6. The assembly as set forth in claim 5 wherein the first portion defines a plurality of first holes spaced from each other and the second portion defines a plurality of second holes spaced from each other and the second holes align with respective first holes, and further including a plurality of first fasteners, with one of the first fasteners disposed through each of the first and second holes that align with each other such that the first fasteners attach the grinding wheel to the spindle.

7. The assembly as set forth in claim 1 wherein the first portion of the adaptor is a separate piece attached to the distal end of the spindle and the second portion of the adaptor is a separate piece attached to the grinding wheel.

8. The assembly as set forth in claim 7 wherein:

the first portion defines a plurality of first holes spaced from each other and the second portion defines a plurality of second holes spaced from each other and the second holes align with respective first holes, and further including a plurality of first fasteners, with one of the first fasteners disposed through each of the first and second holes that align with each other such that the first fasteners attach the grinding wheel to the spindle;

the first portion defines a plurality of third holes spaced from each other and spaced from the first holes, and the distal end of the spindle defines a plurality of fourth holes spaced from each other, with respective third and fourth holes aligning with each other, and further including a plurality of second fasteners, with one of the second fasteners disposed through each of the third and fourth holes that align with each other such that the second fasteners attach the first portion of the adaptor to the spindle; and the second portion defines a plurality of fifth holes spaced from each other and spaced from the second holes, and the grinding wheel defines a plurality of sixth holes spaced from each other, and further including a plurality of third fasteners, with one of the third fasteners disposed through each of the fifth and sixth holes that align with each other such that the third fasteners attach the second portion of the adaptor to the grinding wheel.

9. A grinder assembly comprising:

a CNC machine;

a spindle supported by the CNC machine, with the spindle selectively rotatable about a central axis, with rotation of the spindle controlled by the CNC machine;

a grinding wheel attachable to and detachable from the spindle, with the grinding wheel rotatable about the central axis when attached to the spindle; and an adaptor cooperating with the spindle and the grinding wheel to provide a quick attachment and detachment of the grinding wheel with the spindle, and wherein the adaptor includes a plurality of first teeth extending outwardly relative to the spindle and a plurality of second teeth extending outwardly relative to the grinding wheel, with the first and second teeth cooperating with each other to selectively attach the grinding wheel to the spindle and prevent independent rotation of the grinding wheel relative to the spindle;

wherein:

the adaptor includes a first portion cooperating with the spindle and a second portion cooperating with the grinding wheel;

the first portion of the adaptor defines a recess and includes a component disposed in the recess, with the component movable axially relative to the central axis in the recess;

the first portion includes the first teeth extending outwardly therefrom;

the second portion includes the second teeth extending outwardly therefrom, with contact between respective first and second teeth limiting radial movement of the grinding wheel relative to the central axis when the grinding wheel is attached to the spindle;

at least a portion of the first and second faces engage each other to limit axial movement of the grinding wheel relative to the spindle when the grinding wheel is attached to the spindle;

the component includes a first side and a second side spaced from each other, with the first side disposed proximal to the first face and the first teeth extend outwardly from the first side of the component and the first portion includes a biasing member disposed between the second side and a bottom surface of the recess such that the biasing member continuously biases the component outwardly away from the bottom surface;

the biasing member is further defined as a plurality of biasing members disposed between the second side and the bottom surface of the recess;

the first portion includes a plurality of pins fixed to the component in a spaced relationship, with at least one of the biasing members surrounding part of each of the pins.

10. The assembly as set forth in claim 9 wherein:

the first portion cooperates with a distal end of the spindle;

the first portion includes the first teeth extending outwardly therefrom; and the second portion includes the second teeth extending outwardly therefrom, with contact between respective first and second teeth limiting radial movement of the grinding wheel relative to the central axis when the grinding wheel is attached to the spindle.

11. The assembly as set forth in claim 10 wherein the adaptor includes a locating feature that positions the grinding wheel relative to the spindle in the same location each time the grinding wheel is attached to the spindle; wherein the locating feature includes a projection extending outwardly relative to one of the first portion and the second portion, and wherein the locating feature includes an opening defined by the other one of the first portion and the second portion, with the projection extending into the opening when the grinding wheel is attached to the spindle.

12. The assembly as set forth in claim 11 wherein the projection extends outwardly relative to the first portion and the second portion defines the opening.

13. A grinder assembly comprising:

a spindle selectively rotatable about a central axis;

a grinding wheel attachable to and detachable from the spindle, with the grinding wheel rotatable about the central axis when attached to the spindle; and an adaptor cooperating with the spindle and the grinding wheel to provide a quick attachment and detachment of the grinding wheel with the spindle, and wherein the adaptor includes a plurality of first teeth extending outwardly relative to the spindle and a plurality of second teeth extending outwardly relative to the grinding wheel, with the first and second teeth cooperating with each other to selectively attach the grinding wheel to the spindle and prevent independent rotation of the grinding wheel relative to the spindle;

wherein:

the adaptor includes a first portion cooperating with a distal end of the spindle and a second portion cooperating with the grinding wheel;

the first portion includes the first teeth extending outwardly therefrom;

the second portion includes the second teeth extending outwardly therefrom, with contact between respective first and second teeth limiting radial movement of the grinding wheel relative to the central axis when the grinding wheel is attached to the spindle;

the first portion includes a first face and the second portion includes a second face, with at least a portion of the first and second faces engaging each other to limit axial movement of the grinding wheel relative to the spindle when the grinding wheel is attached to the spindle;

the first portion defines a recess and includes a component disposed in the recess, with the component movable axially relative to the central axis such that the first face of the first portion engages the second face of the second portion when the grinding wheel is attached to the spindle;

the component includes a first side and a second side spaced from each other, with the first side disposed proximal to the first face and the first teeth extend outwardly from the first side of the component and the first portion includes a biasing member disposed between the second side and a bottom surface of the recess such that the biasing member continuously biases the component outwardly away from the bottom surface;

the first face includes a first platform and a second platform each being substantially flat, with the first and second platforms separated by the component;

the second face includes a third platform and a fourth platform each being substantially flat, with the third and fourth platforms separated by the second teeth;

the first and third platforms engage each other when the component biases back toward the bottom surface when the grinding wheel is attached to the spindle, and the second and fourth platforms engage each other when the component biases back toward the bottom surface when the grinding wheel is attached to the spindle.

14. The assembly as set forth in claim 13 wherein the component is a ring configuration.

15. The assembly as set forth in claim 13 wherein the adaptor includes a locating feature that positions the grinding wheel relative to the spindle in the same location each time the grinding wheel is attached to the spindle.

16. The assembly as set forth in claim 13 wherein the biasing member is further defined as a plurality of biasing members disposed between the second side and the bottom surface of the recess.

17. The assembly as set forth in claim 16 wherein the first portion includes a plurality of pins fixed to the component in a spaced relationship, with at least one of the biasing members surrounding part of each of the pins.

18. The assembly as set forth in claim 15 wherein the locating feature includes a projection extending outwardly relative to one of the first portion and the second portion, and wherein the locating feature includes an opening defined by the other one of the first portion and the second portion, with the projection extending into the opening when the grinding wheel is attached to the spindle.

19. The assembly as set forth in claim 12 further including a pin that secures the projection to one of the first and second portions.

20. The assembly as set forth in claim 1 wherein the component is a ring configuration.

* * * * *